United States Patent [19]

Wilk

[11] Patent Number: 5,005,288

[45] Date of Patent: Apr. 9, 1991

[54] RAZOR

[76] Inventor: Peter J. Wilk, 185 W. End Ave., New York, N.Y. 10023

[21] Appl. No.: 490,921

[22] Filed: Mar. 8, 1990

[51] Int. Cl.[5] ..... B26B 19/38

[52] U.S. Cl. ..... 30/36; 30/41

[58] Field of Search ..... 30/41, 85, 86, 125, 30/128, 124, 36

[56] References Cited

U.S. PATENT DOCUMENTS

| | | | |
|---|---|---|---|
| 2,342,849 | 2/1944 | Evans | 30/36 |
| 2,385,436 | 9/1945 | Evans | 30/36 |
| 3,516,209 | 6/1970 | Virtanen | 51/153 |
| 4,300,285 | 11/1981 | Endo | 30/41 |
| 4,344,227 | 8/1982 | Chen et al. | 32/41 |
| 4,800,649 | 1/1989 | Caraudella | 30/41 |

*Primary Examiner*—Douglas D. Watts

*Attorney, Agent, or Firm*—R. Neil Sudol; Henry D. Coleman

[57] ABSTRACT

A razor comprises a body member, an elongate handle attached to the body member, a blade mounted to the body member, the blade having an exposed, cutting edge, and a cleaning and/or sharpening device slidably secured to the body member for slidingly engaging the blade essentially along the entire cutting edge thereof. An actuator element is operatively connected to the cleaning and/or sharpening device for enabling an operator to shift the cleaning device parallel to the edge of the blade. The cleaning device includes an elongate strip which slidingly contacts the blade along the exposed, cutting edge during a stroke of the actuator element.

20 Claims, 1 Drawing Sheet

RAZOR

BACKGROUND OF THE INVENTION

This invention relates to a razor and, more particularly, to a disposable razor.

A disadvantage common to all razors is the inability of the blades to maintain a sharp edge. Anyone who has shaved with a used razor knows the discomfort and scarred skin that can result from a dull blade.

In addition, a razor which has been previously used bears another disadvantage and that is the unsightly hair and dried shaving cream or gel which accumulates if the razor is not properly and regularly cleaned. Shaving residue frequently remains on or about the blade as well and interferes with the effectiveness of the shave.

OBJECTS OF THE INVENTION

An object of the present invention is to provide a razor with means for ameliorating the above-mentioned disadvantages.

Another object of the present invention is to provide a razor with a mechanism for cleaning the razor, at least in a region about the blade.

Another, more particular, object of the present invention is to provide such a razor with a cleaning device which is easy to operate.

A further particular object of the present invention is to provide a razor with such a cleaning device which is inexpensive to manufacture and which can be incorporated in virtually every disposable razor, as well in many injectors and other razors of a nondisposable type.

An additional object of the present invention is to provide a razor with a mechanism for sharpening the edge or the razor blade.

Another, more specific, object of the present invention is to provide such a razor with a sharpening device which is easy to operate.

A further specific object of the present invention is to provide a razor with such a sharpening device which is inexpensive to manufacture and which can be incorporated in virtually every disposable razor, as well in many injectors and other razors of a nondisposable type.

Yet another object of the present invention is to provide a razor or the disposable type which represents a complete shaving kit.

SUMMARY OF THE INVENTION

A razor in accordance with the present invention comprises a body member, an elongate handle attached to the body member, a blade mounted to the body member, the blade having an exposed, cutting edge, and a cleaning device slidably secured to the body member for slidingly engaging the blade essentially along the entire cutting edge thereof. An actuator element is operatively connected to the cleaning device for enabling an operator to shift the cleaning device parallel to the edge of the blade.

In accordance with a feature of the present invention, the cleaning device includes an elongate strip which slidingly contacts the blade along the exposed, cutting edge during a stroke of the actuator element. The elongate strip is advantageously provided with means for sharpening the edge of the blade during a stroke of the actuator element moving the elongate strip along the edge. The means for sharpening may include an abrasive surface on the elongate strip.

Pursuant to another feature of the present invention, the elongate strip is connected at one end to the actuator element and is slidably inserted at an opposite end into a groove extending in the body member parallel to the cutting edge.

Pursuant to yet another feature of the present invention, the cleaning device includes a pair of elongate strips which slidingly contact the blade along the exposed, cutting edge on opposite sides of the blade during a stroke of the actuator element. The elongate strips are preferably each connected at one end to the actuator element and are each slidably inserted at an opposite end into a groove extending in the body member parallel to the edge.

Pursuant to a particular feature of the present invention, the actuator element includes a knob.

Pursuant to another specific feature of the present invention, the razor is provided with a restoring spring operatively connected to the cleaning device for restoring the cleaning device to an initial position upon completion of a sliding motion of the cleaning device along the cutting edge.

Pursuant to yet another feature of the present invention, the handle of the razor is hollow and is filled with a charge of shaving gel. An actuator is provided for enabling manual discharge of at least a portion of the gel.

A razor in accordance with the present invention is provided with an integral cleaning device capable of easily cleaning the razor, at least in a region about the blade. The razor is inexpensive to manufacture and which can be incorporated in virtually every disposable razor, as well in many injectors and other razors of a nondisposable type. The cleaning device may also serve to sharpen the cutting edge or the razor blade.

DETAILED DESCRIPTION

Figure 1:
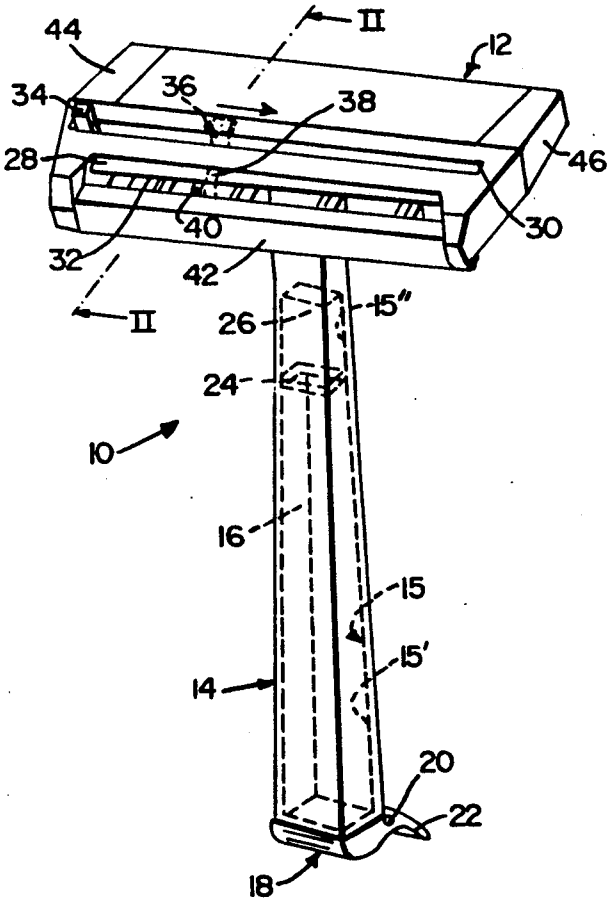
FIG. 1 is a perspective view of a razor, showing cleaning and/or sharpening device in accordance with the present invention.

As illustrated in FIG. 1, a razor 10 includes a razor body or head member 12 attached to a elongate hollow handle 14. Handle 14 is provided with a chamber 15 containing a charge of shaving gel 16 which can be released in measured portions by tilting open a spring loaded door 18 pivotably attached at 20 to the free end of handle 14. Door 18 is provided with a lever arm 22 for facilitating the opening of the door, e.g. with the thumb.

Gel 16 is pushed towards door 18 by a pressure element 24 which engage the inner surfaces of chamber 15 in essentially an air-tight sliding fit. Pressure element 24 divides chamber 15 into two subchambers 15' and 15''.

Subchamber 15' is coextensive with the charge of shaving gel 16, while subchamber 15" is filled with a gas 26 under pressure. Upon the opening of door 18, gas 26 expands and forces pressure element 24 towards the door to thereby eject a portion of gel 16.

Other techniques for ejecting gel from a container and other devices, such as toothpaste or tooth cleaning gel dispensers, are known in the art and may be used in practicing the instant invention.

Figure 2:
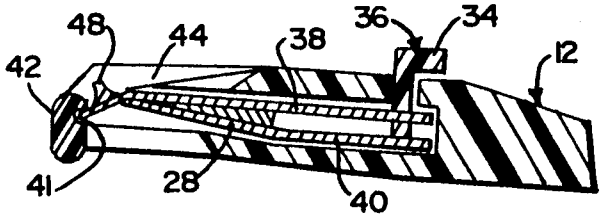
FIG. 2 is a cross-sectional view taken along line II—II in FIG. 1.

As further illustrated in FIG. 1, head member 12 is provided with an elongate fixed blade member 28 and with an elongate slot 30 extending parallel to a cutting edge 32 of blade member 28. Slidably disposed in slot 30 is an actuator knob 34 of a blade cleaning device 36 illustrated in detail in FIG. 2.

Blade cleaning device 36 includes a pair of elongate strips 38 and 40 each attached at one end to actuator knob 34 and inserted at an opposite end into an elongate groove 41 extending parallel to cutting edge 32 in an elongate bridge member 42 which serves as a guide bar facilitating an optimal positioning of blade 28 with respect to a skin surface to be shaved. Bridge member 42 is connected at its opposite ends to a pair of bracket portions 44 and 46 of head member 12. Blade 28 is also connected at its opposite ends to bracket portions 44 and 46.

Figure 3:
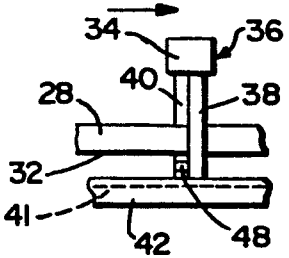
FIG. 3 is a partial top view of the cleaning and/or sharpening device included in the razor of FIG. 1.

Strips 38 and 40 are each bent towards the other in the region of cutting edge 32 to increase the force with which the strips contact blade 28 in the region of edge 32. Lower strip 40 is provided in front of cutting edge 32 with a kink or crimp 48 whereby the forward end of that lower strip may be inserted into groove 41. Strips 38 and 40 are staggered along the length of blade 28, as illustrated in FIG. 3.

Figure 4:
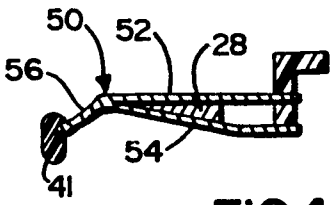
FIG. 4 is a partial cross-sectional view, similar to FIG. 2, showing another embodiment of the present invention.

In an alternative embodiment of the present invention, depicted in FIG. 4, an essentially wishbone-shaped cleaning strip 50 has a pair of legs or prongs 52 and 54 which contact blade 28 on opposite sides thereof. The cleaning strip includes a finger or extension 56 at the junction of the two legs or prongs 52 and 54, the free end of the finger or extension being inserted into elongate guide groove 41.

In using blade cleaning device 36, knob 34 is pushed in the direction of arrow 58 (FIGS. 1 and 3), thereby sliding strips 38 and 40 along blade 28 to clean the blade. After a using razor 10 to shave a skin surface, the user may push knob 34 the entire length of blade 28 from bracket portion 44 to bracket portion 46 and left in the latter portion until a subsequent cleaning operation after the next shave. Alternatively, knob 34 and strips 38 and 40 may be moved several times along the length of blade 28. Such a multiple motion is particularly desirable to sharpen cutting edge 32. After the sharpening operation is complete, cleaning device 36 may be left in either bracket portion 44 or 46.

Strips 38 and 40 are preferably made of a material which has a honing effect when moved along the material of blade 28. The strip material may be a synthetic resin with embedded abrasive particles or a leather-like material, whereby strips 38 and 40 act in the manner of old-fashioned strops.

Figure 5:
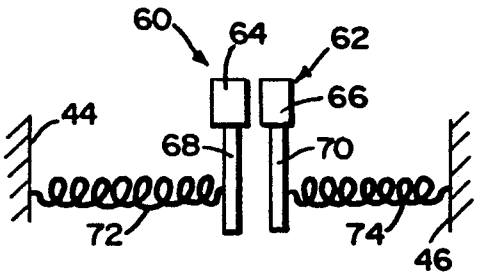
FIG. 5 is a diagram of yet another embodiment of a cleaning device and/or sharpening device which can be incorporated into conventional razors, in accordance with the present invention.

As illustrated in FIG. 5, an another embodiment of the invention includes a pair of blade cleaning devices 60 and 62 each including an actuator knob 64 or 66 and a cleaning and/or sharpening strip 68 or 70 attached to a respective bracket portion 44 or 46 by a restoring spring 64 or 66. In operation, knobs 64 and 66 are pushed towards one another by thumb and forefinger. Upon an engagement of cleaning devices 60 and 62, the knobs are released, whereupon the cleaning devices are returned to their home positions in bracket portions 44 and 46 through the action of restoring springs 64 and 66.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are preferred by way of example to facilitate comprehension of the invention and should not be construed to limit the scope thereof.

What is claimed is:

1. A razor comprising:

a body member;

an elongate handle attached to said body member;

a blade mounted to said body member, said blade having an exposed edge and a width perpendicular to said edge;

cleaning means slidably secured to said body member for slidingly engaging said blade along said exposed edge; and actuator means operatively connected to said cleaning means for enabling an operator to shift said cleaning means parallel to said edge, said cleaning means including an elongate strip extending essentially permanently from in front of said edge across said width of said blade.

2. The razor set forth in claim 1 wherein said elongate strip slidingly contacts said blade along said exposed edge during a stroke of said actuator means.

3. The razor set forth in claim 2 wherein said elongate strip is provided with means for sharpening said edge during a stroke of said actuator means moving said elongate strip along said edge.

4. The razor set forth in claim 3 wherein said means for sharpening includes an abrasive surface on said elongate strip.

5. The razor set forth in claim 2 wherein said elongate strip is connected at one end to said actuator means and is slidably inserted at an opposite end into a groove extending in said body member parallel to said edge.

6. The razor set forth in claim 1 wherein said elongate strip is one of a pair of elongate strips which slidingly contact said blade along said exposed edge on opposite sides of said blade during a stroke of said actuator means.

7. The razor set forth in claim 7 wherein said elongate strips are each connected at one end to said actuator means and are each slidably inserted at an opposite end into a groove extending in said body member parallel to said edge.

8. The razor set forth in claim 1 wherein said elongate strip takes the form of an elongate strop member.

9. The razor set forth in claim 1 wherein said actuator means includes a knob.

10. The razor set forth in claim 1, further comprising restoring means operatively connected to said cleaning means for restoring said cleaning means to an initial position upon completion of a sliding motion of said cleaning means along said edge.

11. The razor set forth in claim 10 wherein said restoring means include a spring.

12. The razor set forth in claim 11 wherein said handle is hollow, further comprising charge of shaving gel in said handle and means actuatable by an operator for discharging at least a portion of said gel.

13. A disposable comprising:

a body member;

a blade mounted to said body member, said blade having an exposed edge;

an elongate hollow handle attached to said body member;

a charge of shaving gel in said handle;

means actuatable by an operator for discharging at least a portion of said gel;

cleaning means slidably secured to said body member for slidingly engaging said blade essentially along the entire exposed edge thereof; and actuator means operatively connected to said cleaning means for enabling an operator to shift said cleaning means parallel to said edge.

14. A razor comprising:

a body member;

an elongate handle attached to said body member;

a blade mounted to said body member, said blade having an exposed edge and a width perpendicular to said edge;

sharpening means slidably secured to said body member for slidingly engaging said blade along said exposed edge and for sharpening said edge during a stroke of said sharpening means along said edge; and actuator means operatively connected to said sharpening means for enabling an operator to shift said sharpening means parallel to said edge, said sharpening means including an elongate strip extending essentially permanently from in front of said edge across said width of said blade.

15. The razor set forth in claim 14 wherein said an elongate strip slidingly contacts said blade along said exposed edge during a stroke of said actuator means.

16. The razor set forth in claim 15 wherein said elongate strip is provided with means for cleaning said edge during a stroke of said actuator means moving said elongate strip along said edge.

17. The razor set forth in claim 15 wherein said means for sharpening includes an abrasive surface on said elongate

18. The razor set forth in claim 15 wherein said elongate strip is connected at one end to said actuator means and is slidably inserted at an opposite end into a groove extending in said body member parallel to said edge.

19. A razor comprising:

a body member;

an elongate handle attached to said body member;

a blade mounted to said body member, said blade having an exposed edge;

cleaning means slidably secured to said body member for slidingly engaging said blade along said exposed edge; and actuator means operatively connected to said cleaning means for enabling an operator to shift said cleaning means parallel to said edge, said cleaning means includes an elongate strip which slidingly contacts said blade along said exposed edge during a stroke of said actuator means, said elongate strip being connected at one end to said actuator means and slidably inserted at an opposite end into a groove extending in said body member parallel to said edge.

20. A razor comprising:

a body member;

an elongate handle attached to said body member;

a blade mounted to said body member, said blade having an exposed edge;

sharpening means slidably secured to said body member for slidingly engaging said blade along said exposed edge and for sharpening said edge during a stroke of said sharpening means along said edge; and actuator means operatively connected to said sharpening means for enabling an operator to shift said sharpening means parallel to said edge, said sharpening means including an elongate strip which slidingly contacts said blade along said exposed edge during a stroke of said actuator means, said elongate strip being connected at one end to said actuator means and slidably inserted at an opposite end into a groove extending in said body member parallel to said edge.

* * * * *